US005813867A

United States Patent [19]

Hodge

[11] Patent Number: 5,813,867

[45] Date of Patent: Sep. 29, 1998

[54] RF CONNECTOR WITH QUICK DISCONNECT

[75] Inventor: Ronald L. Hodge, Flowery Branch, Ga.

[73] Assignee: Scientific-Atlanta, Inc., Norcross, Ga.

[21] Appl. No.: 757,225

[22] Filed: Nov. 27, 1996

[51] Int. Cl.[6] ..... H01R 9/09

[52] U.S. Cl. ..... 439/63

[58] Field of Search ..... 439/63, 581; 333/33, 333/34, 260

[56] References Cited

U.S. PATENT DOCUMENTS

| | | | |
|---|---|---|---|
| 3,553,607 | 1/1971 | Lehrfeld | 333/34 |
| 3,622,915 | 11/1971 | Davo | 333/34 |
| 3,783,321 | 1/1974 | Patterson | 361/772 |
| 3,915,535 | 10/1975 | O'Keefe et al. | 439/63 |
| 4,125,308 | 11/1978 | Schilling | 439/63 |
| 4,656,441 | 4/1987 | Takahaski et al. | 333/33 |
| 4,659,156 | 4/1987 | Johnescu et al. | 439/63 |
| 4,697,859 | 10/1987 | Fisher, Jr. | 439/246 |
| 4,737,111 | 4/1988 | Minar et al. | 439/63 |
| 4,917,630 | 4/1990 | Hubbard | 439/578 |
| 4,990,109 | 2/1991 | Romerein et al. | 439/801 |
| 4,995,815 | 2/1991 | Buchanan et al. | 439/63 |
| 5,044,990 | 9/1991 | Knotts | 439/578 |
| 5,215,477 | 6/1993 | Weber et al. | 439/581 |
| 5,404,117 | 4/1995 | Walz | 333/34 |
| 5,513,995 | 5/1996 | Kurotori et al. | 439/64 |
| 5,545,847 | 8/1996 | Lynes et al. | 439/65 |

*Primary Examiner*—Neil Abrams
*Assistant Examiner*—Barry M. L. Standig
*Attorney, Agent, or Firm*—Kelly A. Gardner; Kenneth M. Massaroni; Hubert J. Barnhardt, III

[57] ABSTRACT

A connector assembly for electrically coupling an external circuit to a printed circuit board comprises a printed circuit board secured to a housing. The housing has a threaded bore in one end wall and a connector having a threaded end is secured to the end wall via the bore. An electrode extending axially from the threaded end is positioned proximate an electroconductive circuit portion of the printed circuit board and solder electrically connects the electrode to the circuit portion. Fingers are circumferentially spaced about the connector proximate a second end thereof and are resiliently compressed within a cavity formed in a coupling when the connector is inserted into the coupling. An external circuit electrode axially extending within the cavity and electrically connected to the external circuit mates with a female conductor formed in the second end of the connector to complete the electrical connection between the printed circuit board and the external circuit.

25 Claims, 3 Drawing Sheets

RF CONNECTOR WITH QUICK DISCONNECT

INTRODUCTION

The present invention is directed to radio frequency (RF) connectors and, more particularly, to RF connectors for electrically coupling printed circuit boards to external circuits.

BACKGROUND

Radio frequency (RF) connectors are generally used to connect various components of RF equipment. Such RF connectors interconnect various components including coaxial cable and printed circuit boards. Some electronic assemblies require multiple printed circuit boards to be inserted into a chassis which is connected to an external circuit. Specially formed connectors are required for easy installation of printed circuit boards into these chassis as well as removal from the chassis.

One connector is proposed in U.S. Pat. No. 4,737,111 to Minar et al. The connector of Minar et al. is designed for testing printed circuit boards and therefore is made to be snapped into place and removed from the printed circuit board. The Minar et al. device comprises a coaxial connector for connecting a circuit to a printed circuit board. The connector has a threaded portion on one end and an electrode and a clamp on an opposed end, the clamp comprising two projections. When the connector is placed against an edge of the printed circuit board such that the electrode contacts a circuit on the printed circuit board, the connector is twisted, thereby inserting the projections into mating holes formed in the printed circuit board. Since this connection is designed for testing various circuit boards, the connector can be removed from the printed circuit board and subsequently attached to another for additional testing.

Another connector is proposed in U.S. Pat. No. 3,783,321 to Patterson. The connector of Patterson is a coaxial connector which has a first end which mates with standard coaxial cable connector while the second end extends through a hole in a wall of a box housing a printed circuit board. The second end is generally cylindrical with two opposed flattened surfaces and slots interconnecting the flattened surfaces. An electrode extends from the second end for electrical connection with the printed circuit board. A bracket has a U-shaped portion which fits through the slots to retain the connector against the wall of the box, and tabs which support the printed circuit board. Additionally a retaining ring is provided to secure the connector to the box. The construction of this connector is complex as it requires numerous parts which must be manufactured with precision in order to assure good contact between the connector and the printed circuit board. The design of the connector also increases assembly time and cost due to the number of parts.

It is an object of the present invention to provide an improved connector which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of certain preferred embodiments.

SUMMARY

The principles of the invention may be used to advantage to provide an improved connector assembly for establishing an electrical connection to an electroconductive circuit portion exposed on the outer surface of a printed circuit board which is secured to a housing. A bore is provided in an end wall of the housing and a threaded first end of a connector extends through the bore and is secured to the housing. An electrode extending from the first end is positioned proximate the circuit portion and is soldered or otherwise electrically connected thereto. A coupling having a cavity formed therein with an external circuit electrode extending within the cavity is secured to a chassis and connected to an external circuit. A female conductor is formed in a second end of the connector and mates with the external circuit electrode when the connector is inserted into the coupling.

The principles of the invention may also be used to advantage to provide a plurality of fingers circumferentially spaced about the connector proximate the second end which are resiliently compressed within the cavity of the coupling when the connector is inserted into the coupling.

The principles of the invention may also be used to advantage in a method of electrically connecting an external circuit to a printed circuit board comprising the steps of forming a bore in an end wall of a housing, mounting a circuit board having an electroconductive circuit portion to the housing, extending a threaded first end of a connector through the bore, securing the first end to the housing such that an electrode extending from the first end is proximate the circuit portion, soldering the electrode to the circuit portion, and inserting the housing into a chassis such that the connector is electrically connected to a coupling secured to the chassis.

From the foregoing disclosure, it will be readily apparent to those skilled in the art, that is, to those who are knowledgeable or experienced in this area of technology, that the present invention provides a significant technological advance. The connector assembly provides a rugged and secure connection between the printed circuit board and an external circuit, and one which can be secured easily and remotely. That is, the connector and coupling can be attached simply by inserting the housing into the chassis until the connector engages the coupling. The connector assembly provides for reduced expense and ease of manufacturing, as well as ease of assembly. These and further additional features and advantages of the invention will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
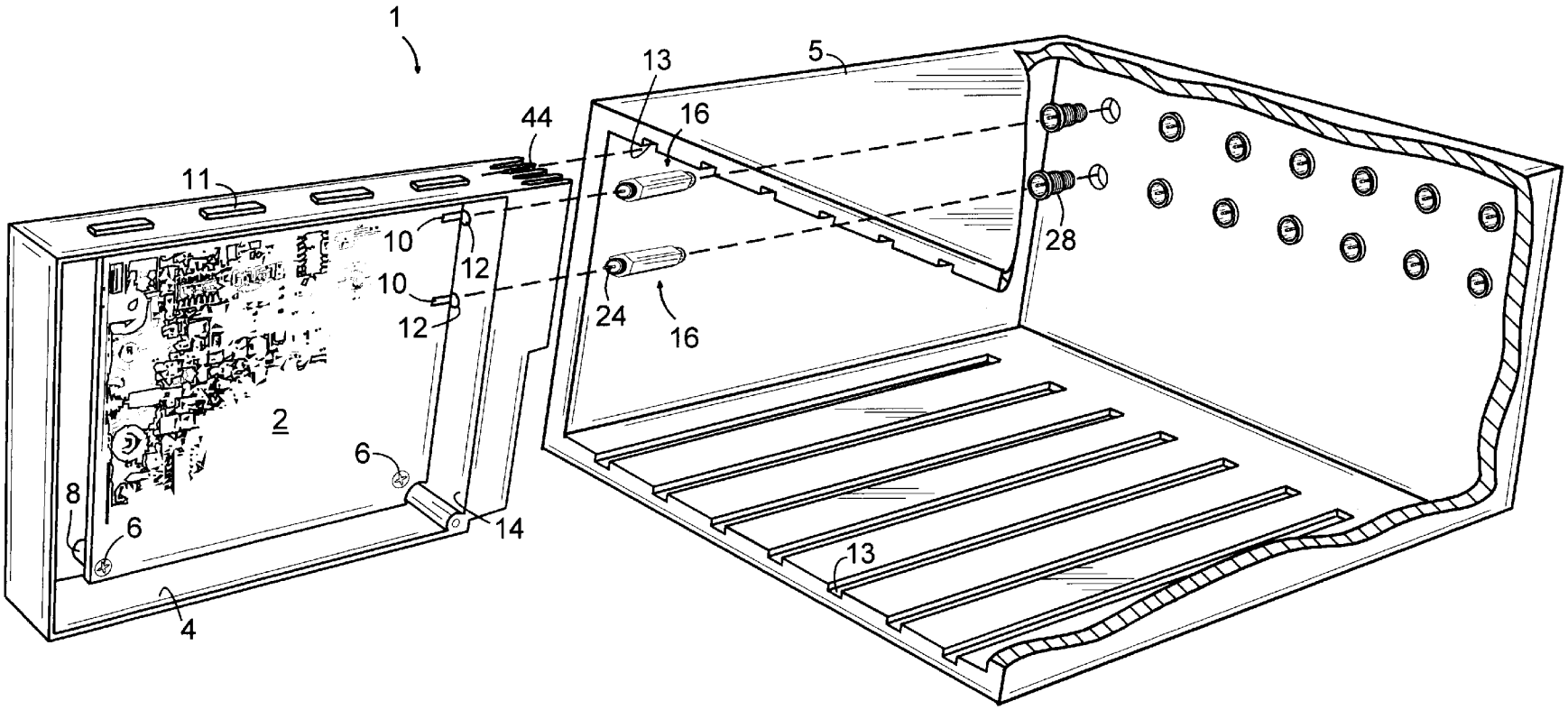
FIG. 1 is a schematic perspective view, shown partially assembled and partially cut away, of a preferred embodiment of the connector assembly of the present invention including a connector to be attached to a circuit board for insertion into a housing.

The figures referred to above are not drawn necessarily to scale and should be understood to present a simplified representation of the invention, illustrative of the basic principles involved. Some features of the RF connector depicted in the drawings have been enlarged or distorted relative to others to facilitate explanation and understanding. The same reference numbers are used in the drawings for similar or identical components and features shown in various alternative embodiments. RF connectors as disclosed above, will have configurations and components determined, in part, by the intended application and environment in which they are used.

DETAILED DESCRIPTION OF CERTAIN PREFERRED EMBODIMENTS

Printed circuit boards are often components of a larger system. In such systems the printed circuit boards may be secured within housings which are in turn contained within a rack and panel system or chassis. The connection between the printed circuit board and the chassis is typically at the rear of the printed circuit board and at the back of the chassis and therefore enclosed by the chassis, and as a result, access to this connection point can be difficult. Connector assemblies are required which can be manufactured and assembled with ease and facilitate such "blind mate" connections.

Figure 3:
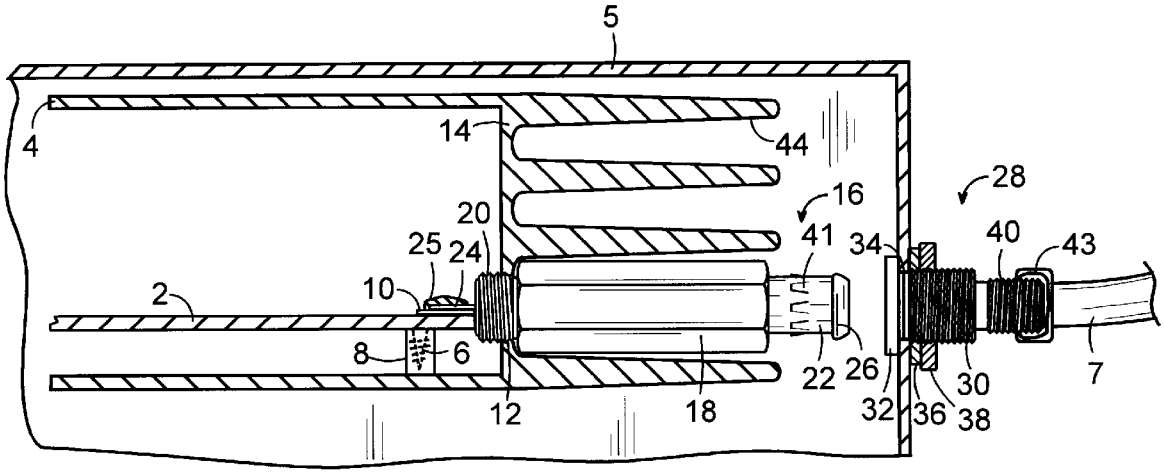
FIG. 3 is a partial section view taken along lines 3—3 of FIG. 2.

A preferred embodiment of a connector assembly, generally designated by the reference numeral 1, is shown in a partially assembled manner in FIG. 1. Printed circuit board 2 is secured within housing 4 with fasteners 6. Connector 16, described in detail below, has electrode 24 extending from one end thereof. Electroconductive circuit portion 10 is provided on printed circuit board 2 proximate one edge thereof. Coupling 28 is secured to a rear wall of chassis 5. When assembled, connector 16 extends through bore 12 formed in end wall 14 of housing 4 and is secured to housing 4 such that electrode 24 (as seen in FIG. 3) contacts or is at least in close proximity to circuit portion 10. Engaging members or tongues 11, formed on outer surfaces of housing 4, and engaged members or grooves 13, formed on inner surfaces of chassis 5, mesh with one another as housing 4 is inserted into chassis 5 (see broken line). It is to be appreciated that the engaging members and engaged members may be of any suitable means, such as dovetail type tongue and grooves, which facilitate the meshing of the engaging and engaged members, and that other suitable means will become apparent to those skilled in the art given the benefit of this disclosure. Tongues 11 may be comprised of multiple segments as shown in FIG. 1, or may be continuous members extending along housing 4. Tongues 11, in other embodiments, may be formed on only one of the upper or lower outer surfaces of housing 4, and mating grooves 13 may be formed on only one corresponding upper or lower interior surface of chassis 5. As housing 4 is inserted into chassis 5, connector 16 engages coupling 28 in a "blind-mate" fashion, that is, an individual can make the connection simply by grasping the housing 4, meshing tongues 11 with grooves 13, and sliding housing 4 into chassis 5 until connector 16 positively engages coupling 28. Such construction eliminates the need for a user to contact the connector 16 or the coupling 28 which may be inaccessible.

In a further embodiment, as shown here in FIG. 1, each housing 4 has a set or plurality of connectors 16 (two are shown here) which mate with a corresponding set or plurality of couplings 28. In another embodiment, chassis 5 has a plurality of sets of couplings 28 to receive sets of connectors 16 from corresponding multiple housings 4 inserted into chassis 5.

Figure 2:
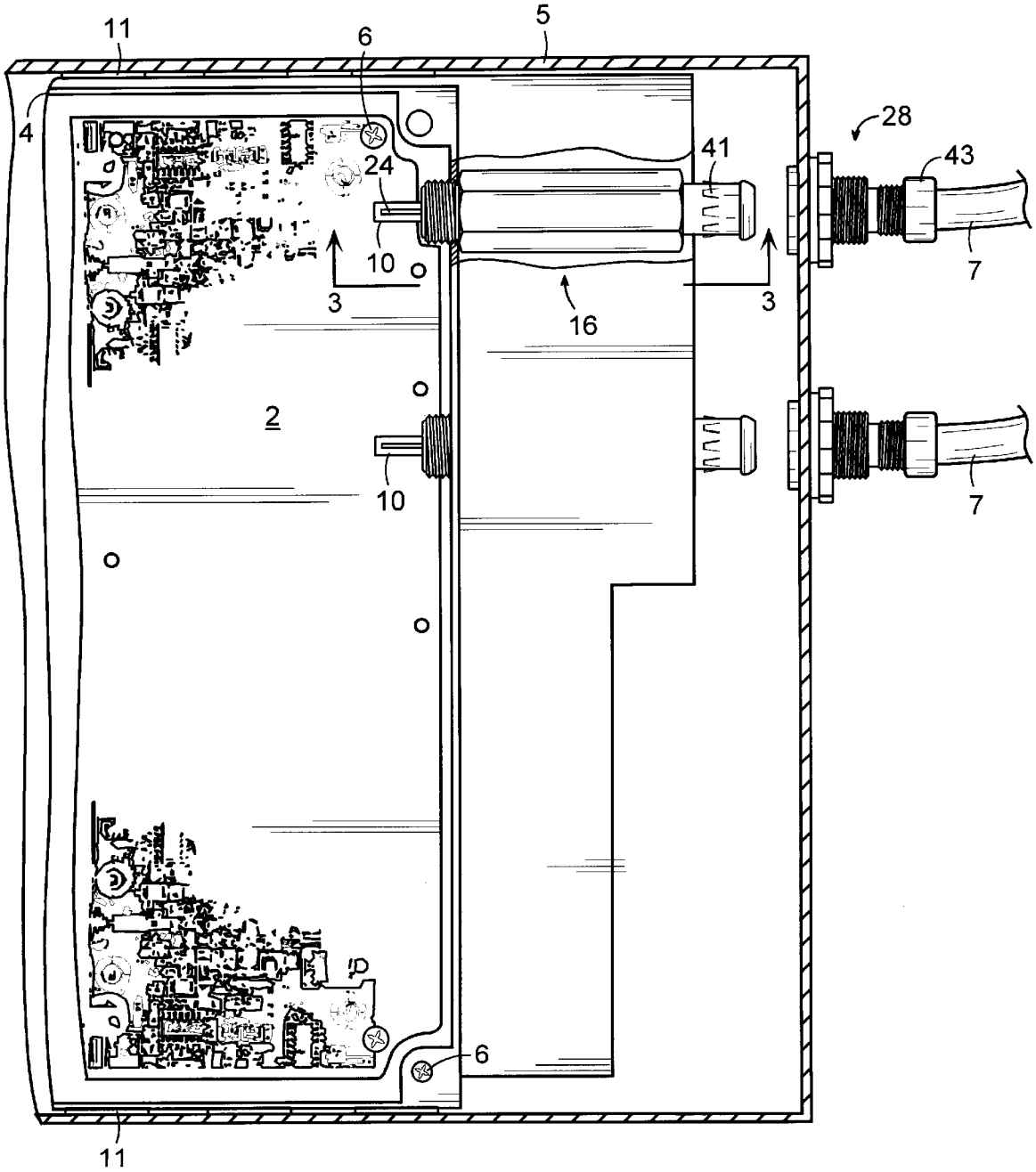
FIG. 2 is a schematic plan view of the housing, partially cut away, with the connector of FIG. 1 attached, being inserted into the chassis.

In FIG. 2 housing 4 is shown partially engaged with chassis 5 with connectors 16 being secured to housing 4. Couplings 28, which will engage with connectors 16, are connected to an external circuit comprising coaxial cable 7. It is to be appreciated that the external circuit, depicted here as cable 7, may be any combination of external devices such as cables, printed circuit boards, or other devices.

Turning now to FIG. 3 the components of a preferred embodiment of the connector assembly are shown in more detail. Housing 4 is typically manufactured of a metallic material which provides a ground contact for the circuit. Fasteners 6 may be screws which threadingly engage female threaded mounting members 8, or other suitable means for rigidly securing printed circuit board 2 within and to housing 4. Printed circuit board 2 has an electroconductive circuit portion 10 on a surface and proximate one edge thereof. Circuit portion 10 is typically a 75 ohm transmission line. Threaded bore 12 is formed in end wall 14 of housing 4.

Connector 16 comprises body portion 18, threaded first end 20 and second end 22, opposed from first end 20. In a preferred embodiment connector 16 is a 75 ohm connector with a 20 dB return loss at 1 ghz. Electrode 24 projects axially from first end 20 along a longitudinal axis of connector 16. The length of electrode 24 is such that when first end 20 is threaded into bore 12 electrode 24 extends along circuit portion 10 substantially parallel and in close proximity to the surface of circuit portion 10. In another preferred embodiment electrode 24 is in contact with circuit portion 10 when connector 16 is secured to housing 4. Bore 12 can easily be positioned in end wall 14 such that electrode 24 is in contact with or in close proximity to circuit portion 10. Solder 25 is applied to electrode 24 and circuit portion 10 ensuring positive contact and a secure connection. First end 20 is electroconductive and provides a ground connection between connector 16 and housing 4 when first end 20 is threaded into bore 12.

In another embodiment 12 is not threaded and first end 20 is secured to housing 4 by any suitable means such as a washer and nut. Other suitable means for securing first end 20 to housing 4 will be readily apparent to those skilled in the art given the benefit of this disclosure.

Flange 26 is formed at the outer edge of second end 22. Flange 26 has a beveled surface so as to assist the insertion of connector 16 into coupling 28. Flange 32 is located at a first end of coupling 28 and externally threaded first portion 30 of coupling 28, having a substantially circular cross section, extends axially from flange 32. Coupling 28 is inserted through bore 34 in chassis 5 until flange 32 abuts chassis 5. Washer 36 and lock nut 38 are then threaded onto first portion 30 to securely fasten coupling 28 to chassis 5. Externally threaded second portion 40, having a substantially circular cross section, extends axially from first portion 30. Second portion 40 is sized to accommodate coaxial connector 43 which connects coaxial cable 7 to coupling 28. Coupling, when used herein, is meant to define any device which provides an electrical connection between the connector 16 and an external circuit. Coupling 28 is electroconductive and may be part number GF-1123-1 manufactured by Gilbert Engineering Inc.

A plurality of electroconductive resilient members or fingers 41 are circumferentially spaced about connector 16 proximate second end 22. Fingers 41 extend upwardly from the surface of connector 16 and toward the first end 20. When second end 22 of connector 16 is inserted into cavity 42 (seen in FIG. 6) of coupling 28, fingers 41 are partially compressed within the cavity. The resilience of fingers 41 presses them outwardly thereby providing a positive contact with the wall of cavity 42. Such positive contact provides a ground connection between connector 16 and coupling 28 and also helps retain connector 16 within coupling 28 thereby providing a sealing, yet releasable contact. In a preferred embodiment fingers 41 are of unitary construction with body portion 18 of connector 16 and are formed of portions of the outer wall of connector 16 which extend away from the surface of the connector.

Fins 44 extend outwardly from end wall 14 so as to provide adequate surface area for cooling of housing 4. Connector 16 is of a length that allows second end 22 to extend beyond fins 44 a sufficient distance to be freely inserted into coupling 28.

Figure 4:
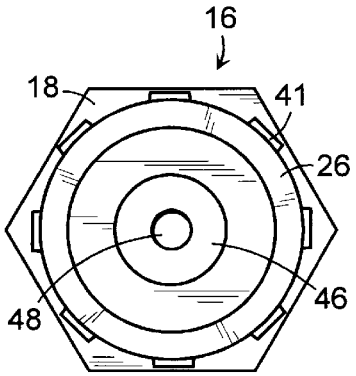
FIG. 4 is a schematic end view of a preferred embodiment of the connector of FIG. 1.

A preferred embodiment of connector 16 can be seen in FIG. 4. Body portion 18 has a hexagonal cross section so that it can receive a wrench to rotate connector 16 as it is threaded into bore 12. Central portion 46 is formed of a dielectric material and surrounds and insulates female conductor 48, which is an axial cavity formed in connector 16, the wall of which is electroconductive and provides electrical contact with male external circuit electrode 50 (seen in FIG. 6) of coupling 28 when connector 16 is inserted into coupling 28.

Figure 5:
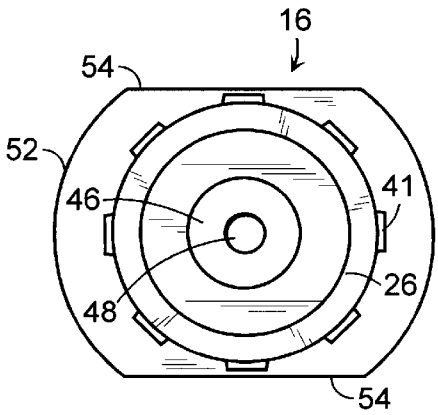
FIG. 5 is a schematic end view of another preferred embodiment of the connector of FIG. 1.

Another preferred embodiment of connector 16 is shown in FIG. 5. Connector body 52 has a generally circular cross section with two diametrically opposed flat portions 54 so that it can receive a wrench to rotate connector 16 as it is threaded into bore 12.

Figure 6:
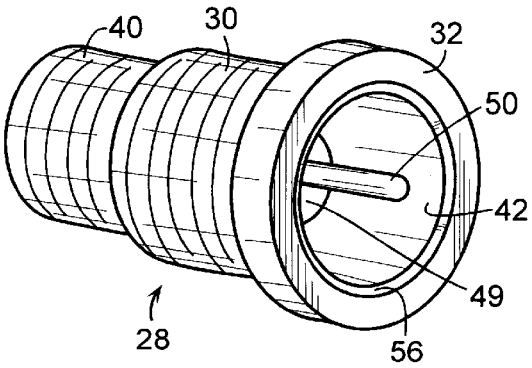
FIG. 6 is a schematic perspective view of a preferred embodiment of the coupling of FIG. 1.

A preferred embodiment of coupling 28 is shown in FIG. 6. Flange 32 has interior beveled edge 56 which cooperates with the beveled surface of flange 26 to guide second end 22 into cavity 42 when engaging connector 16 and coupling 28. Insulating portion 49, formed of a dielectric material, surrounds axially extending external circuit electrode 50. Electrode 50 is electroconductive and engages female conductor 48 when connector 16 is inserted into coupling 28, thereby creating an electrical contact between coupling 28 and connector 16. Electrode 50 of coupling 28 is also connected via coaxial connector 43 to coaxial cable 7 (see FIG. 3) to provide the electrical connection with the external circuit. The wall of cavity 42 is electroconductive, as mentioned above, and creates a ground connection between coupling 28 and fingers 41 of connector 16.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

We claim:

1. A connector assembly for electrically coupling an external circuit to a printed circuit board comprising, in combination:

a housing having an end wall;

a bore formed in the end wall;

a circuit board, having an electroconductive circuit portion, secured to the housing; and a connector having a body portion, a first ends an opposed second end, and an electrode extending from the first end, the first end and the electrode extending through the bore, and the first end secured to the end wall, wherein the electrode is proximate the circuit portion when the first end and the electrode extend through the bore.

2. A connector assembly in accordance with claim 1 wherein the body portion has a hexagonal cross section.

3. A connector assembly in accordance with claim 1 wherein the circuit board comprises a printed circuit board.

4. A connector assembly in accordance with claim 1 wherein the electrode extends axially from the first end.

5. A connector assembly in accordance with claim 1 wherein the bore is threaded, the first end is threaded, and threads of the first end engage threads of the bore to secure the first end to the end wall.

6. A connector assembly in accordance with claim 1 further comprising a plurality of fingers spaced about the connector proximate the second end and a coupling having a cavity formed therein into which the connector can be inserted, wherein said cavity is coupled to the external circuit.

7. A connector assembly in accordance with claim 6 wherein the fingers are spaced circumferentially about the connector.

8. A connector assembly in accordance with claim 6 wherein the fingers are resilient members, the fingers being at least partially compressed within the cavity when the connector engages the coupling.

9. A connector assembly in accordance with claim 6 wherein the fingers are of a unitary construction with the body portion of the connector.

10. A connector assembly in accordance with claim 1 wherein the circuit portion is proximate the bore when the printed circuit board is secured to the housing.

11. A connector assembly in accordance with claim 1 further comprising an external circuit electrode, and a female conductor formed in the second end for receiving the external circuit electrode to provide an electrical connection therewith.

12. A connector assembly in accordance with claim 1 further comprising solder to electrically connect the electrode to the circuit portion.

13. A connector assembly in accordance with claim 1 further comprising:

at least one additional electroconductive circuit portion on the printed circuit board;

at least one additional bore formed in the end wall;

at least one additional connector having a body portion, a first end and an opposed second end, the first end extending through a corresponding additional bore and secured to the housing; and at least one additional electrode axially extending from the first end of a corresponding additional connector, the additional electrode being proximate a corresponding additional circuit portion when the first end is secured to the housing.

14. A connector assembly in accordance with claim 1 wherein the electrode is spaced from and extends substantially parallel to a surface of the circuit portion.

15. A connector assembly in accordance with claim 1 wherein the electrode contacts the circuit portion when the first end is secured to the end wall.

16. A connector assembly for electrically coupling an external circuit to a printed circuit board comprising, in combination:

a chassis connected to an external circuit;

a housing, having an end wall, for insertion into the chassis;

a bore formed in the end wall having threads formed on an inner surface thereof;

a printed circuit board, having an electroconductive circuit portion, secured to the housing;

a connector having a body portion, a first end having threads formed on an outer surface thereof, and an opposed second end, the first end extending through the bore and being threadedly secured to the housing;

an electrode axially extending from the first end of the connector, the electrode being proximate the circuit portion when the first end is secured to the housing;

a coupling, having a cavity formed therein to receive the connector, secured to the chassis;

an external circuit electrode axially extending within the cavity; and a female conductor formed in the second end to receive and form an electrical connection with the external circuit electrode.

17. A connector assembly in accordance with claim 16 wherein wherein both the electrode and the first end extend through the bore when the first end is secured to the end wall of the housing by the bore.

18. A connector assembly in accordance with claim 16 further comprising a plurality of fingers spaced about the body portion proximate the second end, the fingers contacting and forming a ground connection with the cavity when the coupling engages the connector.

19. A connector assembly in accordance with claim 18 wherein the fingers are spaced circumferentially about the body portion.

20. A connector assembly in accordance with claim 18 wherein the fingers are of unitary construction with the body portion of the connector.

21. A connector assembly in accordance with claim 16 wherein the electrode contacts the circuit portion when the first end is secured to the housing.

22. A connector assembly in accordance with claim 16 further comprising solder to electrically connect the electrode to the circuit portion.

23. A connector assembly in accordance with claim 16 further comprising first engaging means for aligning the housing within the chassis, said first engaging means formed on outer surfaces of the housing, and second engaging means formed on inner surfaces of the chassis, for mechanically engaging the first engaging means to align the housing with the chassis when the housing is inserted into the chassis.

24. A connector assembly in accordance with claim 23 wherein the engaging members comprise tongues and the engaged members comprise grooves.

25. A connector assembly for electrically coupling an external circuit to a printed circuit board, comprising:

a housing having an end wall;

a bore formed in the end wall, the bore having a threaded inner surface;

a circuit board, having an electroconductive circuit portion, secured to the housing;

a connector having:

a body portion, a first end having threads formed on an outer surface thereof and further having an electrode extending axially therefrom, and an opposed second end, wherein the first end and the electrode extend through the bore such that the outer surface of the first end is threadedly secured to the inner surface of the bore, and wherein the electrode is proximate the circuit portion when the first end is secured to the end wall by the bore.

* * * * *